US005354225A

United States Patent [19]

Hix

[11] Patent Number: 5,354,225

[45] Date of Patent: Oct. 11, 1994

[54] TOY WATER GRENADE

[76] Inventor: Scott G. Hix, 1028 Morrell Ct., Kingsport, Tenn. 37664-3451

[21] Appl. No.: 139,763

[22] Filed: Oct. 22, 1993

[51] Int. Cl.[5] ..... A63H 33/30; F42B 8/00; A63B 65/00

[52] U.S. Cl. ..... 446/180; 273/428; 434/11; 102/368; 102/498; 102/482; 446/473; 446/475

[58] Field of Search ..... 446/180, 473, 475, 401, 446/405, 176; 102/368, 498, 482; 273/418, 428; 434/11; 222/78, 639, 638

[56] References Cited

U.S. PATENT DOCUMENTS

| | | | |
|---|---|---|---|
| 3,492,945 | 2/1970 | Filippi | 102/498 |
| 3,878,639 | 4/1975 | Scheelar et al. | 446/473 |
| 5,018,449 | 5/1991 | Eidson, II | 102/498 |

*Primary Examiner*—Mickey Yu
*Attorney, Agent, or Firm*—E. Michael Combs

[57] ABSTRACT

A housing is arranged to include a fluid chamber, with the fluid chamber arranged with a surrounding pneumatic chamber. A piston member is arranged for sliding displacement along the reservoir chamber upon removal of a release pin, such that upon the piston exposing pneumatic entry ports into the fluid chamber effects pressurization of fluid within the fluid chamber and expels such fluid in an array from the housing.

5 Claims, 4 Drawing Sheets

TOY WATER GRENADE

BACKGROUND OF THE INVENTION

1. Field of the Invention

The field of invention relates to toy apparatus, and more particularly pertains to a new and improved toy water grenade wherein the same is arranged to simulate an explosive device.

2. Description of the Prior Art

Toy grenade structure is indicated in the prior art such as exemplified by the U.S. Pat. Nos. 3,878,639 and 4,461,117.

The instant invention sets forth a new and improved toy water grenade structure arranged to provide for advantages over the prior art to provide for a time delay to simulate actual grenade functioning upon removal of a release pin relative to grenade housing structure.

SUMMARY OF THE INVENTION

In view of the foregoing disadvantages inherent in the known types of toy grenade apparatus now present in the prior art, the present invention provides a toy water grenade wherein the same is arranged to provide for expulsion of fluid from within the grenade housing upon removal of an associated release pin permitting pneumatic pressurizing of the fluid. As such, the general purpose of the present invention, which will be described subsequently in greater detail, is to provide a new and improved toy water grenade which has all the advantages of the prior art toy grenade apparatus and none of the disadvantages.

To attain this, the present invention provides a housing arranged to include a fluid chamber, with the fluid chamber arranged with a surrounding pneumatic chamber. A piston member is arranged for sliding displacement along the reservoir chamber upon removal of a release pin, such that upon the piston exposing pneumatic entry ports into the fluid chamber effects pressurization of fluid within the fluid chamber and expels such fluid in an array from the housing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toy water grenade which has all the advantages of the prior art toy water grenade apparatus and none of the disadvantages.

It is another object of the present invention to provide a new and improved toy water grenade which may be easily and efficiently manufactured and marketed.

It is a further object of the present invention to provide a new and improved toy water grenade which is of a durable and reliable construction.

An even further object of the present invention is to provide a new and improved toy water grenade which is susceptible of a low cost of manufacture with regard to both materials and labor, and which accordingly is then susceptible of low prices of sale to the consuming public, thereby making such toy water grenades economically available to the buying public.

Still yet another object of the present invention is to provide a new and improved toy water grenade which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
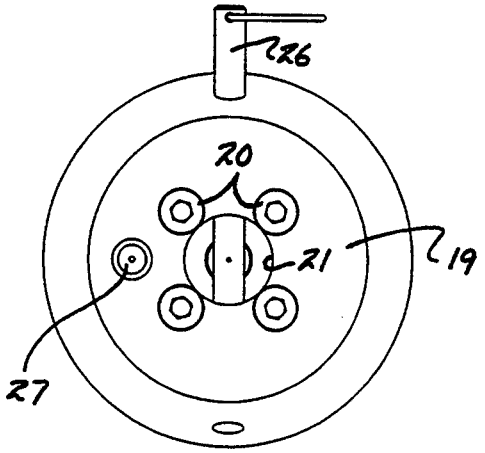
FIG. 1 is an orthographic top view of the invention.
Figure 2:
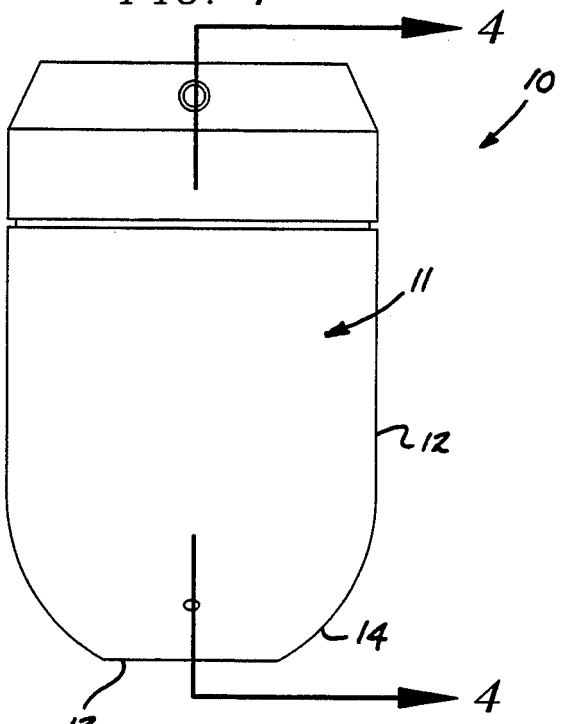
FIG. 2 is an orthographic side view of the invention.
Figure 3:
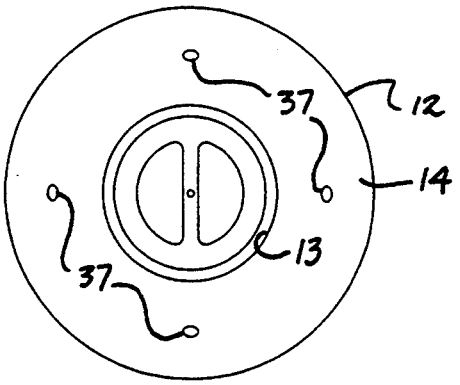
FIG. 3 is an orthographic bottom view of the invention.

With reference now to the drawings, and in particular to FIGS. 1 to 8 thereof, a new and improved toy water grenade embodying the principles and concepts of the present invention and generally designated by the reference numeral 10 will be described.

Figure 4:
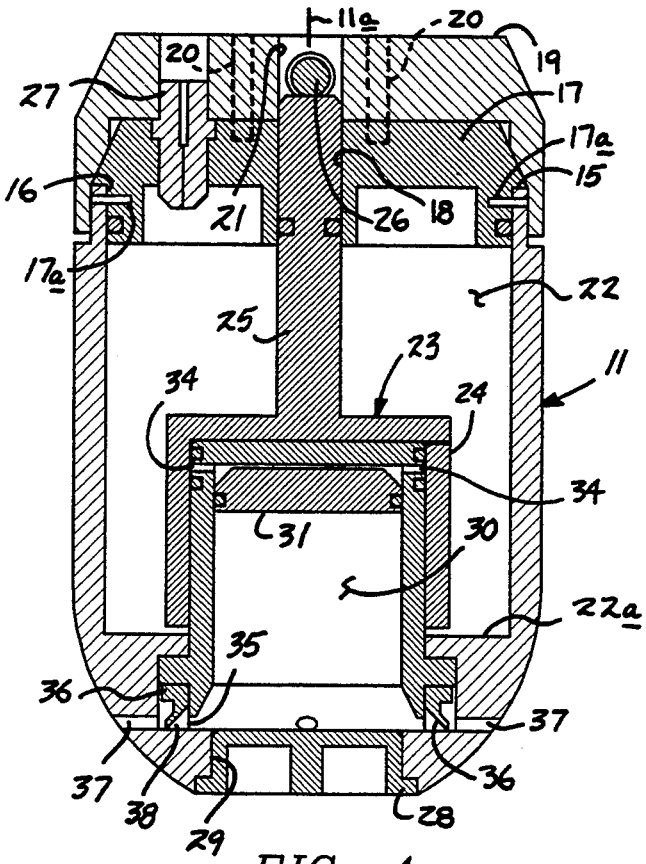
FIG. 4 is an orthographic view, taken along the lines 4—4 of FIG. 1 in the direction indicated by the arrows indicating the piston in a first position.

More specifically, the toy water grenade 10 of the instant invention essentially comprises a generally cylindrical housing 11 symmetrically oriented about an axis 11*a*, such as indicated in FIG. 4. The housing includes a first end 13 spaced from a second end 15, with the side wall 12 having an arcuate transition side wall portion 14 extending from the side wall 12 to the first end 13. The second end 15 is formed with a second end central opening 16 arranged to fixedly receive a second end plug 17 therewithin secured to the housing by way of plug pins 17*a* directed through the second end plug 17 and the housing at the second end 15, as illustrated in FIG. 4. The second end plug 17 is formed with a plug bore 18 coaxially aligned with the housing axis 11*a*. A cover head 19 secured onto the plug bore 18 and symmetrical with the axis 11*a* is secured via fasteners 20 (see FIGS. 1 and 4) providing ease of assembly of the cover head to the second end plug 17 permitting disassembly of the organization for maintenance and repair as required. A cover head bore 21 in pneumatic communication with the plug bore 18 is directed through the cover head bore 21. An air chamber 22 is formed within the housing between the first end and the second end in a communication with the plug bore 18 and the cover head bore 21. An air chamber resilient fill valve 27 is arranged to receive a fill pin (see FIG. 6) for pneumatic pressurization of the air chamber 22. Any convenient source of pressurized air may be employed. A piston cup 23 is positioned within the air chamber 22, having a cup side wall 24 and a piston rod 25 that is slidably directed through the plug bore 18 and the cover head bore 21. In this manner, the piston cup 23 is coaxially aligned relative to the axis 11*a* and reciprocatably mounted within the air chamber 22. A piston rod release pin 26 is directed through the cover head 19, such as indicated in the FIGS. 1 and 4 for example. In this manner, upon removal of the release pin 26, the piston rod 25 and the associated piston cup 23 reciprocate from a first position, as illustrated in FIG. 4, in adjacency to the first end 13 to a second position to contiguously engage the second end plug 17.

Figure 5:
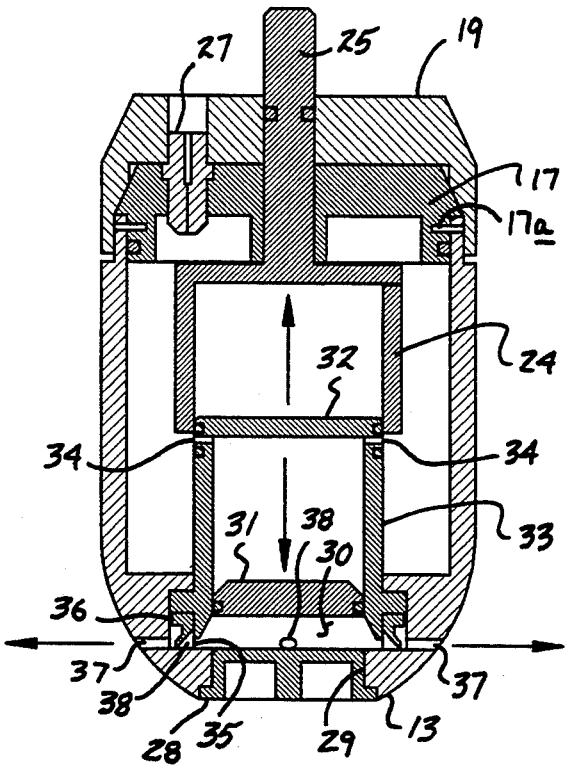
FIG. 5 is an orthographic cross-sectional illustration of the invention with the piston in a second displaced position.

A first end plug 28 is removably mounted through the first end 13, with the first end plug 28 either frictionally or threadedly received within the first end to provide access to a first end opening 29 to provide for directing fluid within a generally cup-shaped fluid chamber 30 receiving such fluid, as illustrated in FIGS. 4 and 5. The fluid chamber includes a fluid chamber floor 32 as well as a fluid chamber side wall 33, such that the fluid chamber 30 is complementarily received within the piston cup 23 in the first position, with the piston cup side wall 24 spaced from the air chamber floor 22*a* in the first position, such that upon removal of the release pin 26 permits ease of pressurized air to engage the side wall annular end and, by air flow through orifice 23*a*, pressurizing the space between the piston cup 23 and the fluid chamber floor 32 thereby slowly directing the piston rod 25 through the plug bore 18 and the cover head bore 21, as illustrated in FIG. 5. The fluid chamber floor 32 is arranged to receive a fluid chamber piston 31 in the first position, with a plurality of pneumatic entry ports 34 directed through the fluid chamber side wall 33 in adjacency to the floor 32 below the fluid chamber piston 31, such that upon displacement of the piston cup 23 from the first position to the second position exposes the pneumatic entry ports 34 to direct pneumatic pressure to pressurize the fluid chamber 30 that is oriented between the piston 31 and the first end plug 28. Fluid outlet conduits 35, as illustrated in FIG. 4, are oriented between the fluid chamber side wall 33 and the first end 13 such that pressurizing of the fluid within the fluid chamber 30 displaces an annular resilient seal 36 positioned within an annular chamber 38 directing the fluid from the fluid chamber 30 through the fluid outlet conduits 35 and through the fluid outlet ports 37 projecting exteriorly of the arcuate transition side wall portion 14. It may be understood that the housing may be formed without the side wall portion 14, wherein the arcuate side wall portion is provided merely for permitting spray to be directed along the side wall and towards the first end 13. In this manner, it is understood that upon removal of the release pin 26, a time delay is effected between the first position, as illustrated in FIG. 4, to the second position, as illustrated in FIG. 5, to expose the pneumatic entry ports 34 to simulate an actual grenade and a time delay fuse in this regard.

Figure 6:
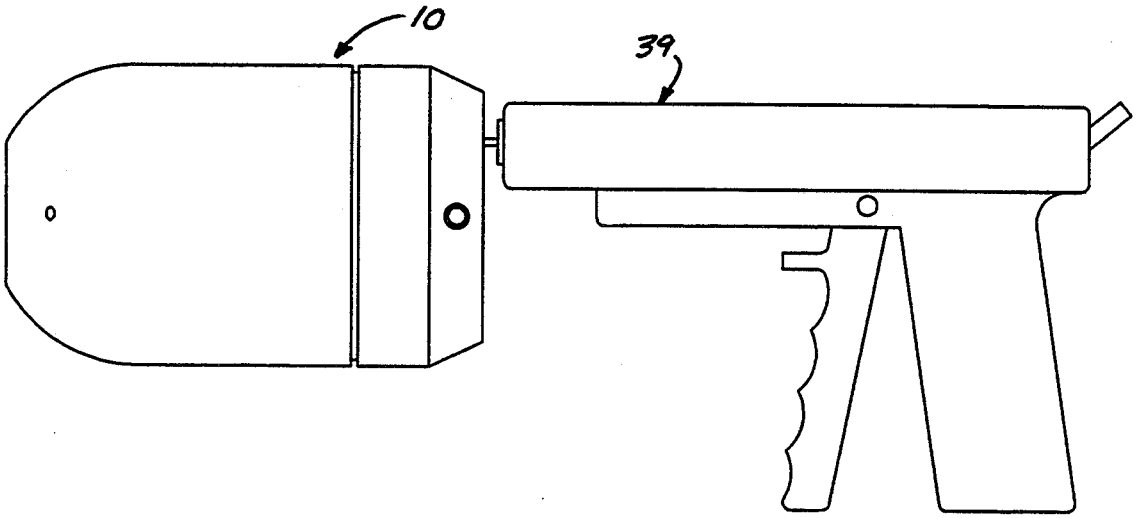
FIG. 6 is an orthographic view of a pressurizing gun for use by the invention.
Figure 7:
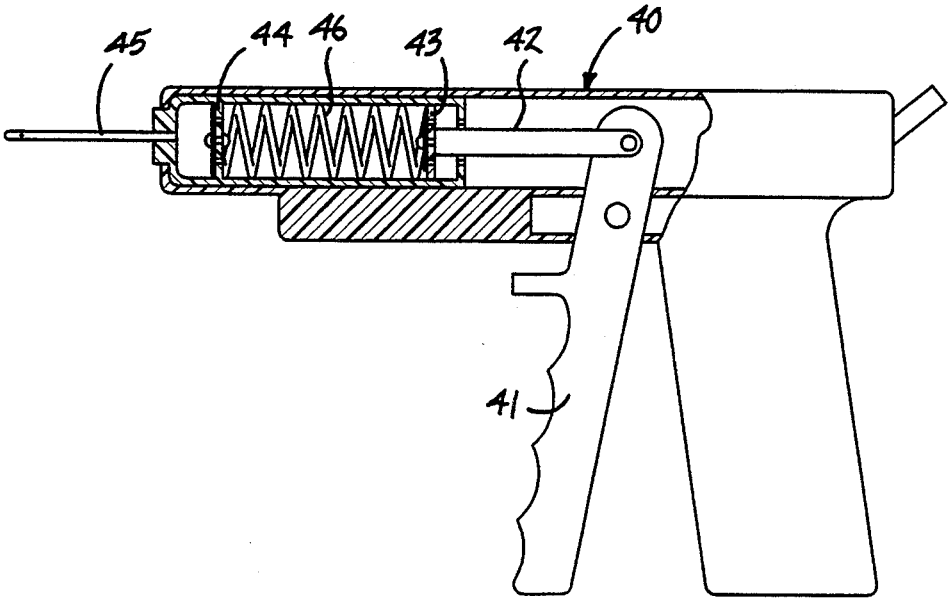
FIG. 7 is an orthographic view, partially in cross-section of the pressurizing gun.

The FIGS. 6 and 7 indicate the use of a pneumatic fill gun 39 having a gun housing 40, wherein a gun lever 41 displaces a plunger 42, such that first and second apertured valve plates 43 and 44 having a central spring 46 directed therebetween directs pressure through a fill needle 45 to be received within the fill valve 27. It is also repeated that any source of pressurized air may be employed utilizing a fill needle of a type as indicated in FIGS. 4 and 5, with any suitable fill valve structure 27.

Figure 8:
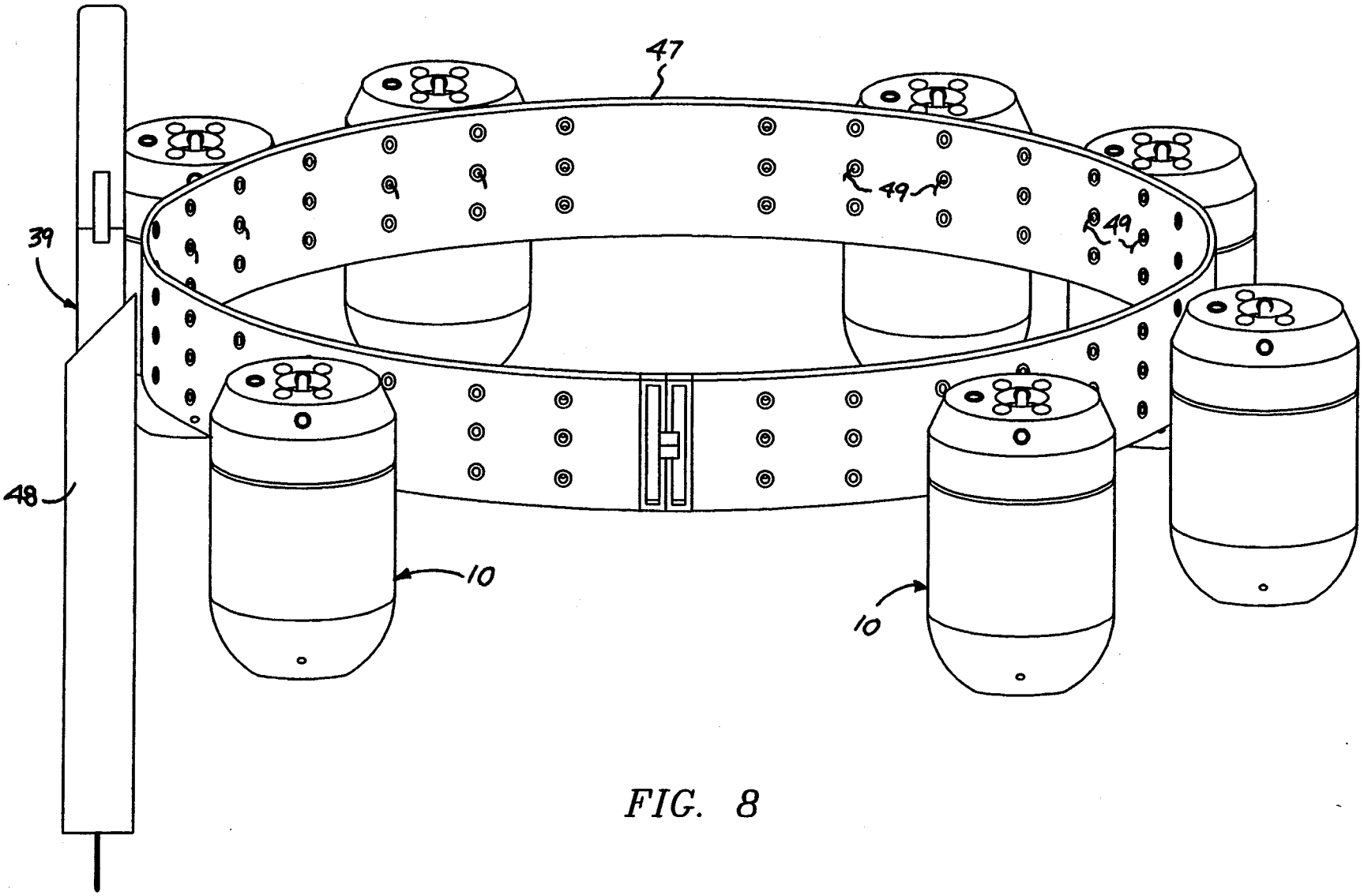
FIG. 8 is an isometric illustration of the invention to include a support belt to mount the pressurizing gun in a plurality of the grenade members.

The FIG. 8 indicates that a support belt 47 may be provided having a holster 48 to receive the pneumatic fill gun 39, as well as spaced apertures to receive side wall legs 49 mounted to the housing side wall 12 to permit support of plurality of the grenade structure members about the belt 47.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toy water grenade, comprising, a housing, the housing symmetrically oriented about a housing axis, and having a housing side wall, a first end wall and a housing second end, with the second end having a second end central opening directed into the housing from the second end, the first end wall including a first end plug removably mounted through the first end wall into the housing, and a second end plug fixedly mounted within the second end central opening, and a cover head fixedly secured onto the second end plug, with the second end plug including a plug bore, and the cover head having a cover head bore, with the cover head bore and the plug bore coaxially aligned in pneumatic communication relative to one another, and the housing further having an air chamber within the housing between the second end plug, and an air chamber floor within the housing spaced from the housing first end wall, and a cup-shaped fluid chamber fixedly mounted within the air chamber in facing relationship relative to the first end plug, and a piston cup complementarily and slidably mounted over the cup-shaped fluid chamber, with the piston cup having a piston rod slidably received through the plug bore and the cover head bore, and air valve means mounted through the cover head and the second end plug permitting pneumatic pressurization of the air chamber, and release means slidably received within the cover head arranged for abutment with the piston rod for permitting reciprocation of the piston rod through the cover head and the second end plug upon removal of the release means relative to the cover head.

2. A grenade as set forth in claim 1 wherein the release means includes a release pin slidably and reciprocatably directed through the cover head arranged for abutment with a free distal end of the piston rod.

3. A grenade as set forth in claim 2 wherein the piston cup includes a piston cup side wall, and the fluid chamber is arranged to include a fluid chamber side wall and a fluid chamber floor, with the fluid chamber floor and the fluid chamber side wall in contiguous communication with the piston cup in a first position, whereupon the fluid chamber floor is separated relative to the piston cup in a second position, wherein the fluid chamber side wall includes a plurality of pneumatic entry ports in communication with the fluid chamber and the air chamber, whereupon the pneumatic entry ports are exposed in the second position.

4. A grenade as set forth in claim 3 further including a plurality of fluid outlet ports directed through the housing side wall, with the fluid outlet ports in fluid communication with the fluid chamber, and an annular resilient seal arranged in surrounding relationship relative to the fluid chamber interposed between the fluid chamber and the fluid outlet ports whereupon pressurizing of the fluid chamber through the pneumatic entry ports effects displacement of the annular resilient seal directing fluid from the fluid chamber through the fluid outlet ports.

5. A grenade as set forth in claim 4 wherein a fluid chamber piston is reciprocatably mounted within the fluid chamber, with the fluid chamber piston arranged for engagement with the fluid chamber floor in a first position and displaced towards the housing first end wall in the second position.

* * * * *